United States Patent [19]

Ingestrand

[11] 4,352,315

[45] Oct. 5, 1982

[54] BARREL SEAL

[75] Inventor: Tore Ingestrand, Karlskoga, Sweden

[73] Assignee: Aktiebolaget Bofors, Bofors, Sweden

[21] Appl. No.: 192,657

[22] Filed: Oct. 1, 1980

[30] Foreign Application Priority Data

Oct. 2, 1979 [SE] Sweden ..... 7908150

[51] Int. Cl.[3] ..... F41H 5/20

[52] U.S. Cl. ..... 89/36 L

[58] Field of Search ..... 89/36 L

[56] References Cited

U.S. PATENT DOCUMENTS 3,710,681 1/1973 Koontz ..... 89/36 L

FOREIGN PATENT DOCUMENTS 823712 1/1938 France ..... 89/36 L

*Primary Examiner*—Stephen C. Bentley

*Attorney, Agent, or Firm*—Pollock, Vande Sande & Priddy

[57] ABSTRACT

The invention relates to a device for sealing of the aperture in a weapon cupola for the barrel of the weapon and which permits elevation movements of the barrel. The device comprises an elongate bellows made of plastic material which is divided into two halves which are in contact with each other along the center line of the barrel aperture. The barrel extends out between and presses the two halves of the bellows apart. Because of the bellows-shaped elastic material, this pressing apart can easily take place, and the bellows resumes its shape and covers the barrel aperture both below and above the barrel. In order to cover the gap which arises just above and below the barrel a protective plate is adapted to the bellows and thus participates in the elevation movements of the barrel.

6 Claims, 4 Drawing Figures

Figure 3:
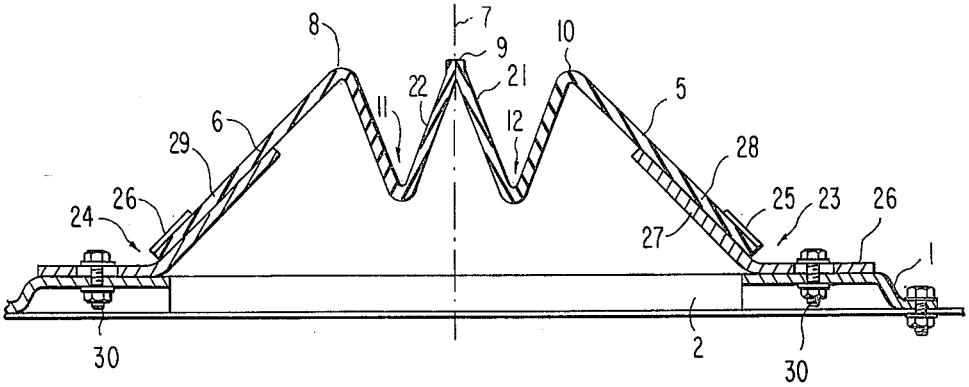

FIG. 1
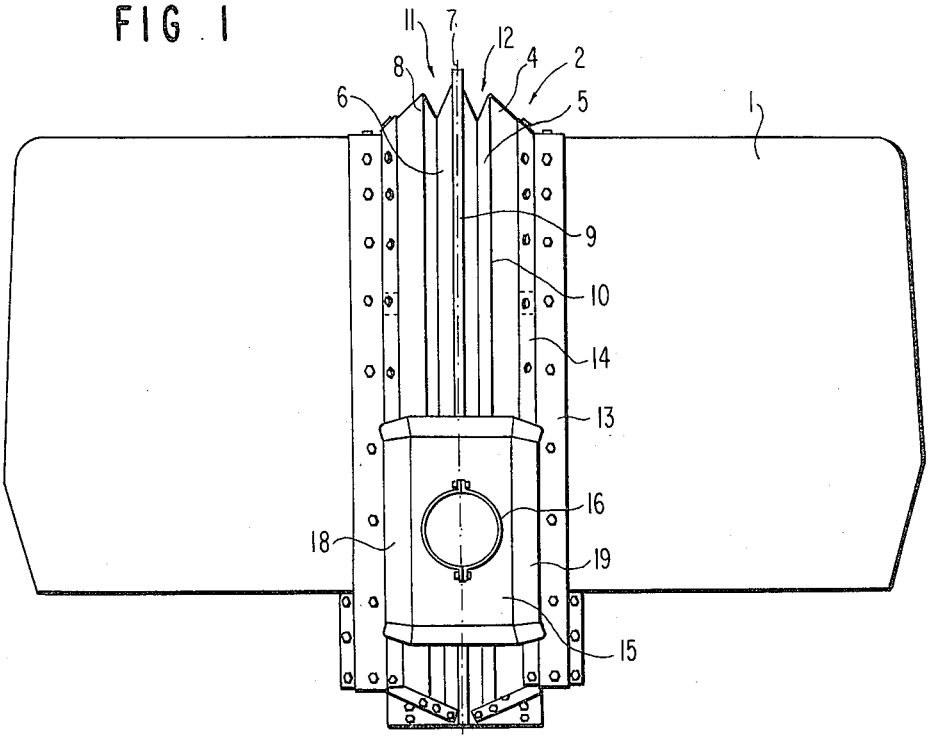
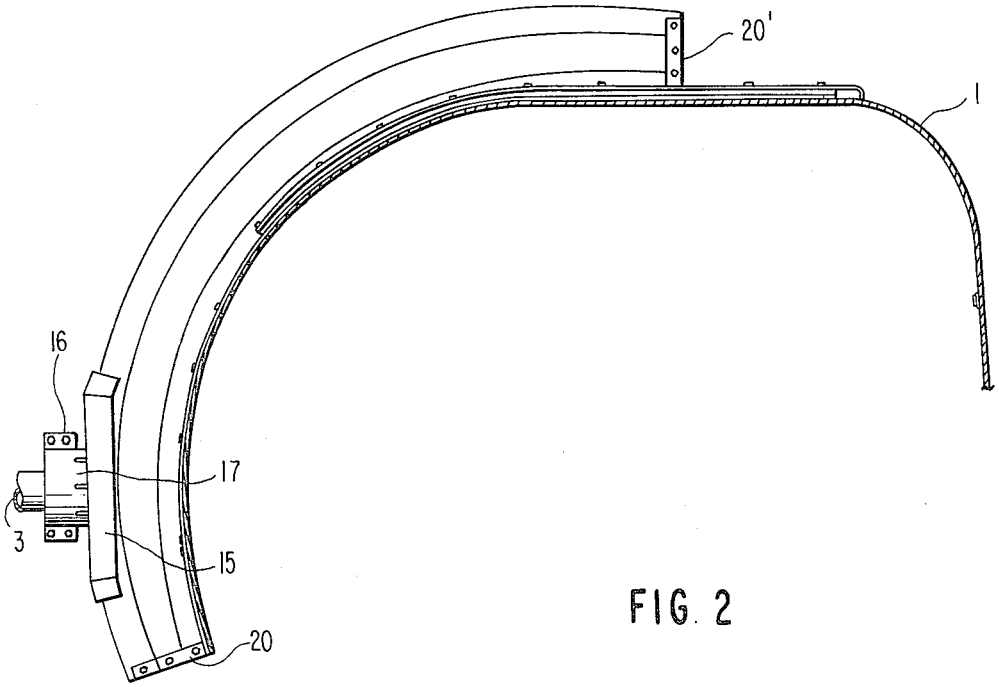
FIG. 2

BARREL SEAL

The present invention relates to a device for sealing the aperture in a weapon cupola for the barrel of the weapon, and permits elevation movements of the barrel.

In order to protect the personnel who operate a weapon from wind and weather and, to a certain extent, from enemy fire, it is previously known to provide the weapon with a cupola which to a greater or lesser extent encloses the actual weapon, including the space for the operators. Such a cupola also protects instruments and sensitive parts of the weapon, for example sight, range finder, etc.

Such cupolas can be made of plate or plastic, and are usually mounted on the weapon so that they traverse with movements of the weapon. The cupola primarily affords front protection, i.e. in the firing direction, but it can also be made in such a way that it gives protection upwards and to the sides, so that it almost completely encloses the weapon and the space for the operators.

The cupola must have an aperture for the barrel of the weapon. This aperture must be sufficiently well dimensioned so that the barrel can move freely in the aperture from the lowest to the highest elevation. Particularly for weapons in which it shall be possible to vary the elevation of the barrel within very wide limits, for instance a ship-based naval gun, it is necessary to have a very elongate aperture in the cupola which, when required, can be sealed in one way or another.

Previous solutions to this problem required the aid of movable covers, which cover the aperture when the barrel is fixed in one direction, but which must be moved when the weapon is elevated. However, such a solution is unpractical, as the entire aperture will be open during firing, and moreover, complicated devices are required for the operation of the covers.

Attempts have also been made to cover the aperture with some flexible material which gives way to the movements of the barrel. However, it has hitherto not been possible to find any material which has been sufficiently strong to withstand the stresses it is subjected to by the elevation movements of the barrel, and which at the same time gives acceptable sealing of the aperture.

The purpose of the present invention is therefore to achieve a device of the above-mentioned kind which gives efficient and durable sealing even of a very elongate aperture in the cupola, and which is simple in design and does not require any complicated, movable parts.

The feature which is characteristic for a device according to the invention is primarily an elongate bellows made of elastic material, divided into two elongate halves which are in contact with each other along the center line of the barrel aperture, the barrel then extending out between the two halves and pressing them apart.

Through such a design of the device, a very efficient and durable seal is achieved, which requires a minimum of parts, and which can easily be adapted to existing weapon cupolas.

Figure 4:
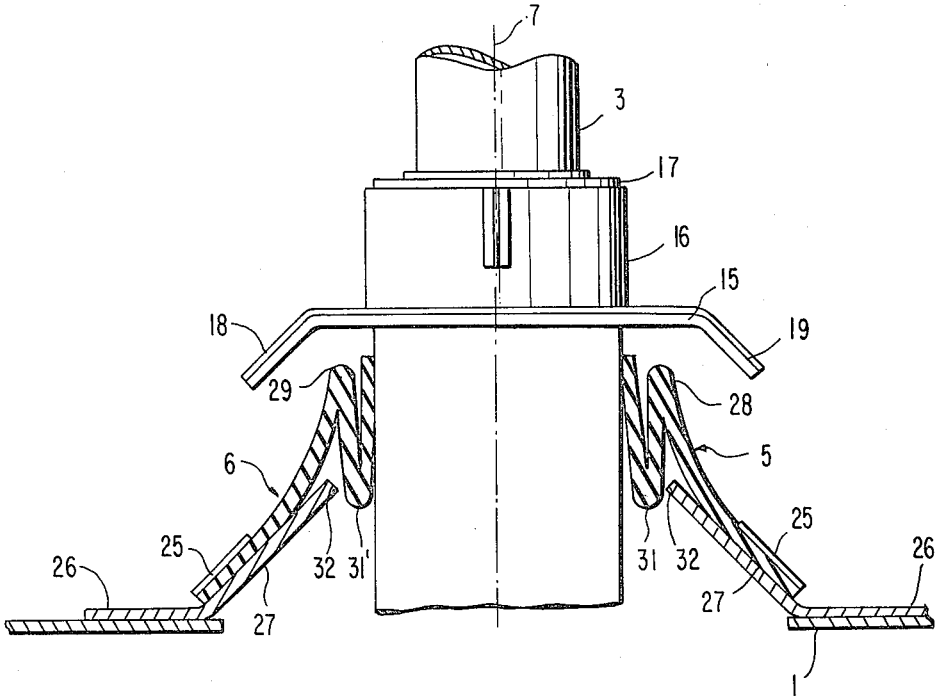

In the following, the invention will be described in more detail, with reference to the attached drawings, in which:

FIG. 1 in a front view shows schematically the cupola and the barrel aperture of a weapon, FIG. 2 in a side view shows schematically the corresponding parts of a weapon, FIG. 3 shows a cross section through the actual barrel seal, and FIG. 4 shows schematically by means of a cross section through the barrel how this presses the two halves of the barrel seal apart.

In all drawing figures, the components which correspond to each other have been given the same reference designations.

FIG. 1 shows a front view of the cupola 1 of a weapon, for instance a ship-based naval gun. The actual cupola can be made of plate, or some plastic material, for instance fibre glass reinforced plastic. The construction or design of the rest of the cupola does not constitute any part of the present invention, and thus will not be described in detail.

In the middle of the cupola, an elongate aperture 2 has been made, through which the barrel 3 of the weapon extends, which will best be noted from FIG. 2. As will be noted from both FIG. 1 and FIG. 2, the aperture 2 extends all the way from the bottom and up in the cupola, which permits elevation movements of the barrel from approx. $-10°$ up to $+90°$.

The barrel aperture 2 is covered by a bellows 4 made of elastic material, such as artificial rubber of a kind which is sun and weather-proof, and which will not be affected by oil or other chemicals which may be used in and around the weapon. One example of an appropriate rubber material is SIS 162001 ethylene propane rubber. In order to permit the barrel to pass through, the bellows is divided into two halves 5, 6 along its entire length, which are in contact with each other along the centre line 7 of the barrel aperture.

As will be seen most clearly from FIG. 3, the bellows is made with folds, and in its entirety comprises three longitudinal raised sections or ridges 8, 9, and 10, and two depressed sections 11 and 12 between them. The joint between the two halves 5 and 6 of the bellows runs along the middle ridge 9. The two halves of the bellows are fastened in the cupola with the aid of two strips 13, 14, which extend along the edges of the barrel aperture 2, as shown in FIG. 3.

The barrel 3 passes out between the two halves 5 and 6 and presses them apart. Because of the seal being made in the form of a bellows of elastic material, this pressing apart takes place easily, and without causing any damage to the seal. The barrel can easily carry out elevation movements in the aperture, and the bellows rapidly resumes its original shape when the barrel passes. The two halves of the bellows are in contact with each other with a light pressure both over and under the barrel. However, just above and below the barrel a gap arises between the two halves. In order to cover this gap, the barrel is provided with a protective plate 15, which with the aid of two clamps 16 is fastened to the neck 17 of the recoil jacket. See FIG. 2. The protective plate 15 is designed in such a way, with folded down sections 18, 19 on both sides, that it is connected with a good fit to the rubber bellows 4 when it moves with the barrel along the aperture in the cupola.

From FIG. 2, which shows a side view of the cupola and the barrel aperture, it will also be noted that the protective plate 15 is folded down at the top and bottom, to adapt to the curved form of the front part of the cupola, particularly so that the protective plate at the top and bottom is lightly in contact with the middle, raised section 9 of the bellows. The ends of the bellows are provided with end pieces 20, 20' made of metal, which constitute both a seal and a support for the bellows.

FIG. 3 shows a cross section through the aperture 2 in the cupola and the bellows 4, from which the folded form of the bellows will be seen more clearly. It will also be noted that the middle, raised section 9 of the bellows is formed by the two parts 21 and 22 of the halves 5 and 6, respectively, of the bellows, and that these are in contact with each other along their upper parts, so that a vertically extending contact surface is formed. The two halves 5 and 6 of the bellows are each mounted on the cupola with the aid of an angular strip, 23 and 24, respectively, designated 13 in FIG. 1, particularly made of fibre glass reinforced plastic, and a strip 25 and 26, respectively, designated 14 in FIG. 1, and which is appropriately made of metal. One part 26 of the angular strip is screwed to the cupola along the edge of the barrel aperture, while its other part 27 is screwed to the inside of the outer side edge 28 and 29, respectively, of the bellows, while the strips 25 and 26 form counter-supports on the outside of the side edges 28 and 29.

In order to permit a certain side movement and, accordingly, adjustment of the contact pressure between the two halves of the bellows, the part 26 of the angular strips 23, 24 has oblong holes for the screws 30, so that the strips can be displaced in the direction towards the barrel aperture.

FIG. 4, finally, shows a cross section through the barrel which shows how the neck 17 of the recoil jacket presses the two halves 5 and 6 of the bellows apart. In order to permit compression of the two halves of the bellows at the side of the neck 17 of the recoil jacket, the part 27 of the angular strip is adapted so that there will be no risk that the lower parts 31, 31′ are pressed against its uppermost part 32. FIG. 4 also clearly shows the folded down sections 18 and 19 of the protective plate 15, which partly cover the side edges 28 and 29 of the bellows.

The invention is not limited to the embodiment shown above as an example, but can be modified within the scope of the accompanying claims.

I claim:

1. In a weapon cupola having an aperture through which a gun barrel extends, a seal between said weapon barrel and aperture comprising:

an elongate elastic bellows having at least three outwardly extending folds, said bellows having first and second ends connected to the edge of said aperture, said bellows divided along a centrally located ridge into first and second halves, said halves abutting said gun barrel periphery and each other along said ridge a distance away from said barrel, said ridge located in a plane coincident with the plane of said gun barrel motion in elevation, whereby motion of said barrel in elevation forces said halves apart in the region adjacent said barrel while maintaining a sealing relationship between halves at a distance away from said barrel.

2. A device according to claim 1 wherein the two halves of the bellows are mounted in the cupola with the aid of strips which extend along the edges of the barrel aperture along its entire length.

3. A device according to claim 2, wherein the strips each consist of an angular strip, one part of which is mounted in the cupola and the other part of which is mounted on the inside of the bellows, and further strip connected as a countersupport on the bellows on its outside.

4. A device according to claim 3, wherein the angular strip which is fastened in the cupola has oblong holes for receiving fastening screws, said holes permitting a certain side movement of the strip for adjusting the contact pressure between the two halves of the bellows.

5. The seal of claim 1 further comprising a protective plate mounted on a recoil jacket of said barrel, said plate forming a cover for gaps occurring between said bellows and said barrel.

6. A device according to claim 5 wherein the protective plate comprises folded sections on lateral sides of the barrel and folded down section above and below the barrel curved to match said aperture.

* * * * *